US007000918B1

(12) United States Patent
Tan

(10) Patent No.: US 7,000,918 B1
(45) Date of Patent: Feb. 21, 2006

(54) HOLISTIC GAME SYSTEM

(76) Inventor: Jude C. Tan, 112-03 111th Ave., South Ozone Park, NY (US) 11420

( * ) Notice: Subject to any disclaimer, the term of this patent is extended or adjusted under 35 U.S.C. 154(b) by 506 days.

(21) Appl. No.: 10/062,933

(22) Filed: Jan. 31, 2002

Related U.S. Application Data

(60) Provisional application No. 60/265,286, filed on Feb. 1, 2001.

(51) Int. Cl.
*A63F 9/00* (2006.01)

(52) U.S. Cl. ..... 273/146; 273/444; 273/440; 273/459; 473/414

(58) Field of Classification Search ..... 273/444, 273/146, 440, 459; 473/414
See application file for complete search history.

(56) References Cited

U.S. PATENT DOCUMENTS 3,208,754 A * 9/1965 Sieve ..... 273/146
3,484,106 A * 12/1969 Foley et al. ..... 273/444
5,156,409 A * 10/1992 Barnes ..... 273/444
5,439,228 A * 8/1995 Pedersen ..... 273/236
5,507,495 A * 4/1996 Kiss ..... 273/243

FOREIGN PATENT DOCUMENTS

GB 2351836 A * 1/2001

OTHER PUBLICATIONS

"Magic Carpets", Book Of 1000 Family Games, Readers Digest Association, Inc. p. 74, 1971.*

* cited by examiner

*Primary Examiner*—Benjamin H. Layno
(74) *Attorney, Agent, or Firm*—Rashida A. Karmali

(57) ABSTRACT

The CHAOS holistic game of this invention comprises an N sided dice with N distinct and different educational graphics one for each side and a plurality of portable bases equal to (P−1)×N where P is the number of players. In this holistic total immersion game the players constitute the game pieces. It can be played indoors as well outdoors and is educational and entertaining both for children and adults. It engages, challenges, involves and benefits body mind and spirit of each player. Almost any educational subject can be taught through this game as the medium of instruction in a fun loving way.

20 Claims, 6 Drawing Sheets

HOLISTIC GAME SYSTEM

HOLISTIC GAME SYSTEM

HOLISTIC GAME SYSTEM

HOLISTIC GAME SYSTEM

HOLISTIC GAME SYSTEM

HOLISTIC GAME SYSTEM

HOLISTIC GAME SYSTEM

HOLISTIC GAME SYSTEM

HOLISTIC GAME SYSTEM

RELATED DOCUMENT

Figure 1:
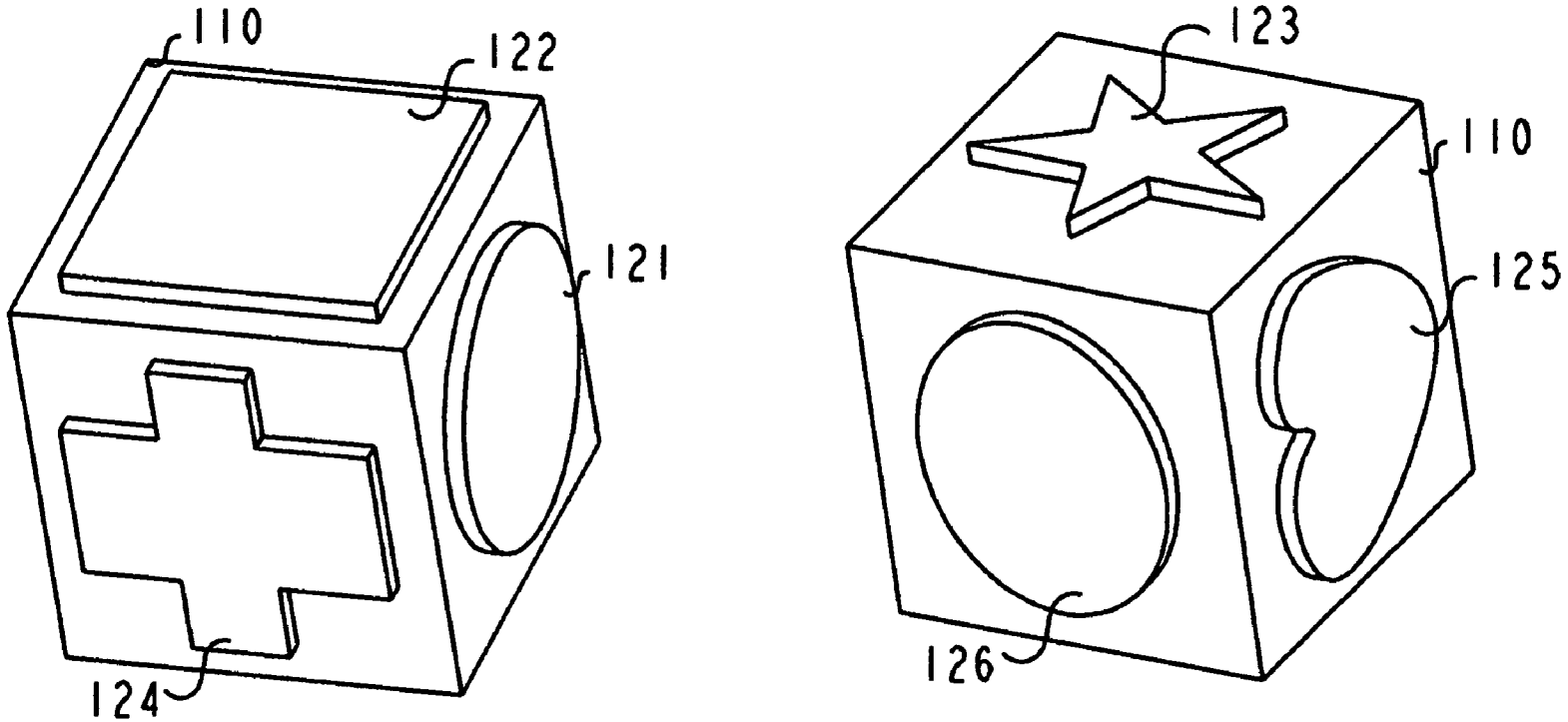

This invention is the same as the provisional application Ser. No. 60/265,286 filed Feb. 1, 2001 by the same inventor under the same title and the inventor claims priority therefrom.

BACKGROUND

This invention relates generally to games. More particularly it relates to a holistic game which totally involves and benefits body mind and spirit of children and adults. An embodiment of the game is also known as CHAOS.

The Problem

The problem with prior art games is that they can either be played indoors or outdoors but not both. Likewise they can either be enjoyed by children or adults but not both. Prior art games are not holistic as they do not involve and benefit body mind and spirit of children and adults both indoor and outdoors. Problems with prior games and toys can be categorized into the following:

a) Useable only indoors or outdoors but not both
b) Challenging to children or adults but not both
c) Provide benefits for the body or mind but not spirit.
d) Not cost effective.
e) Do not harmonize with the environment.
f) Do not totally engage or involve the players.
g) Educational or entertaining but seldom both.

SUMMARY

The CHAOS holistic game of this invention comprises an N sided dice with N distinct and different educational graphics one for each side and a plurality of portable bases equal to $(P-1)\times N$ where P is the number of players.

This indoor-outdoor game appeals equally to children, teens and adults. It can played anywhere! This versatile bundle of fun is the perfect combination of fun and education for all situations! The possibilities for this active game are limitless.

All of this isn't just fun play. Players develop gross motor skills, visual perceptual skills, and spatial relationships. As kids explore the world of shapes, patterns and colors, they begin to develop color recognition, memory and beginning geometry skills.

Players also improve key skills like visual discrimination, and problem solving. This game promotes creative play and socialization. It also encourages more family interactions. Parents or educators can use the cube to teach younger children how to recognize different kinds of shapes, colors or identify images such as different kinds of animals to name a few.

The game is ideal for developing better health, keen mind and strong spirit as well as team spirit among players and family bond and unity, which in turn has positive impact on society by reduced juvenile delinquency and crime.

PRIOR ART

A preliminary limited prior art search was conducted. Furthermore the inventor is intimately familiar with the prior art. Following are typical examples of the prior art known to the applicant arranged in the ascending order of the reference numerals for ready reference of the reader.

a) U.S. Pat. No. 6,053,498 presented to Challen Waychoff on Apr. 25, 2000 for "Game Using Playing Cards, Grab Items, and Body Appendages"
b) U.S. Pat. No. 5,439,228 bestowed upon Geoffrey Pedersen on Aug. 8, 1995 for "Board Game Apparatus and Method of Play'
c) U.S. Pat. No. 5,248,152 issued to John Timmerman on Sep. 28, 1993 for "Footstep Mimic Game"
d) U.S. Pat. No. 3,765,681 granted to Stanley Glassman on Oct. 16, 1973 for "Musical Chairs Game"
e) U.S. Pat. No. 3,454,279 published in the names of Foley et al on Jul. 8, 1969 for "Apparatus for Playing a Game Wherein the Players Constitute the Game Pieces"

None of the prior art devices known to the applicant or his attorney disclose the EXACT embodiment of this inventor that constitutes a simple, elegant, quick, convenient, affordable and fun toy for children.

OBJECTIVES

Unfortunately none of the prior art devices singly or even in combination provide for all of the objectives as established by the inventor for this system as enumerated below.

1. It is an objective of this invention to provide methods, devices and system for playing a holistic game.
2. Another objective of this invention is to provide a game that involves engages and challenges both children and adults.
3. Another objective of this game is that it be suitable for playing indoors as well as out doors.
4. Another objective of this game is that it be both educational and entertaining.
5. Another objective of this game is that it be aesthetic and elegant design that integrates harmoniously with any environment.
6. Another objective of this game is that it involve and benefit body, mind and spirit of all players.
7. Another objective of this game is that it be entertaining as a spectator sport.
8. Another objective of this game is that its use is quick, simple, convenient and easy.
9. Another objective of this invention is that it be suitable for all types of users in all types of weather conditions.
10. Another objective of this invention is that the game be portable.
11. Another objective of this invention is that its design is simple and even elegant.
12. Another objective of this invention is that its use is intuitive which requires no further training.
13. Another objective of the game of this invention is that it be capable of multiple uses.
14. Another objective of this invention is that it use little or no additional energy.
15. Another objective of this invention is that the invention use modular standard components easily interface-able transportable and storable.
16. Another objective of this invention is that it be reliable such that it practically never fails and requires little or no maintenance.
17. Another objective of this invention is that it be environmentally friendly and use biodegrade materials to the extent practical.
18. Another objective of this invention is that it be physically safe in normal environment as well as accidental situations.

19. Another objective of this invention is that it be long lasting made from durable material.

20. Another objective of this invention is that it meet all federal, state, local and other private standards guidelines, regulations and recommendations with respect to safety, environment, energy consumption.

21. Another objective of this invention is that it not compromise the safety or the comfort of the players.

22. Another objective of this invention is that it be suitable for gift giving.

23. Another objective of this invention is that it be suitable for promotional give always complete with message of the sponsor such as a union, casino or charitable organization.

24. Another objective of this invention is that it promote family unity and family bond as well as team spirit, unity and bond among unrelated players.

25. Another objective of this invention is that the game not only be entertaining but capable of learning and teaching almost any subject.

Other objectives of this invention reside in its simplicity, elegance of design, ease of manufacture, service and use and even aesthetics as will become apparent from the following brief description of the drawings and the detailed description of the concept embodiment.

Unfortunately none of the prior art devices singly or even in combination provide all of the features established by the inventor for this system as enumerated below.

a) Comfortable & cool b) Safe.

c) Operative in all seasons.

d) A device that can be easily used, stored, repaired and maintained.

Figure 2:
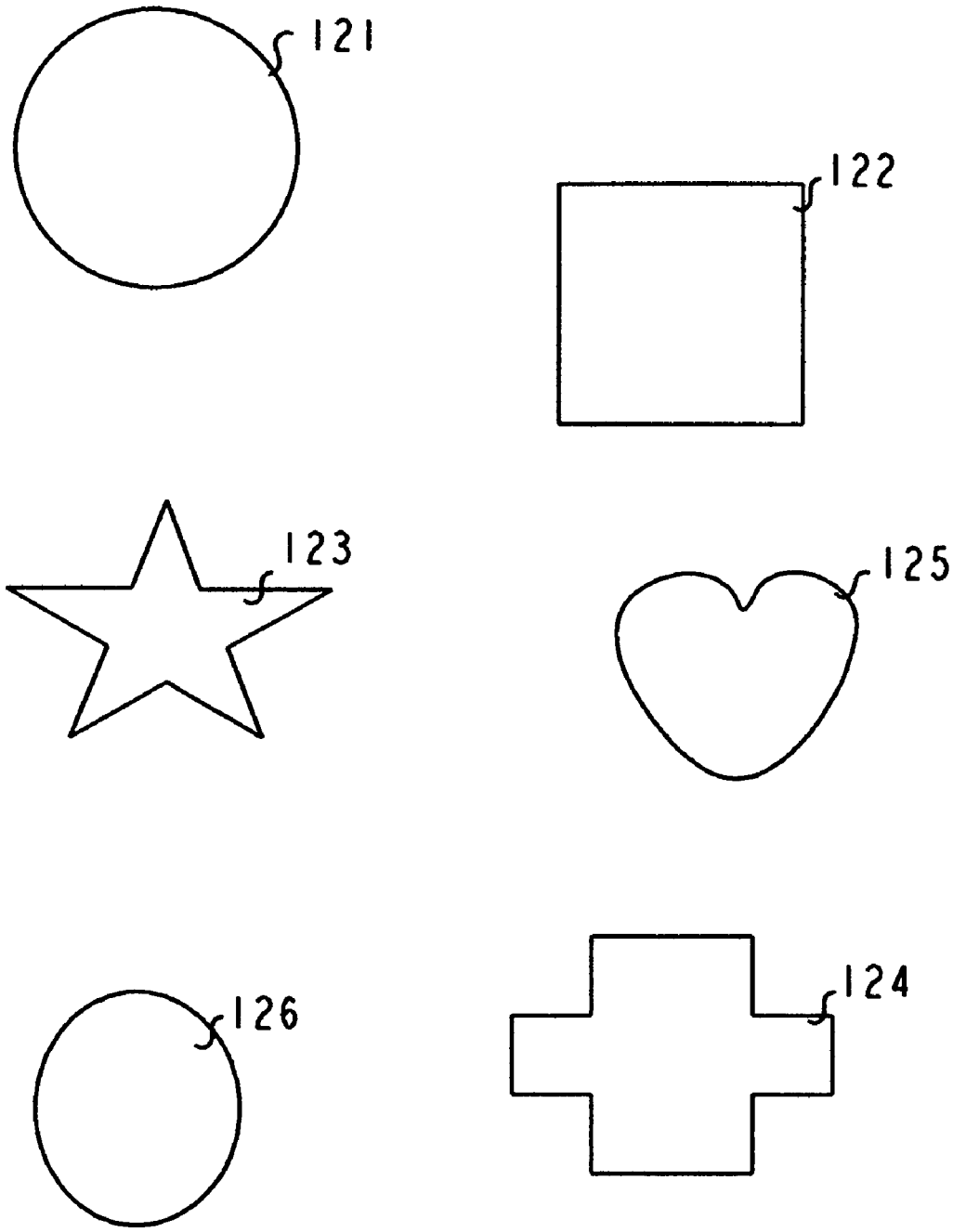
Figure 3:
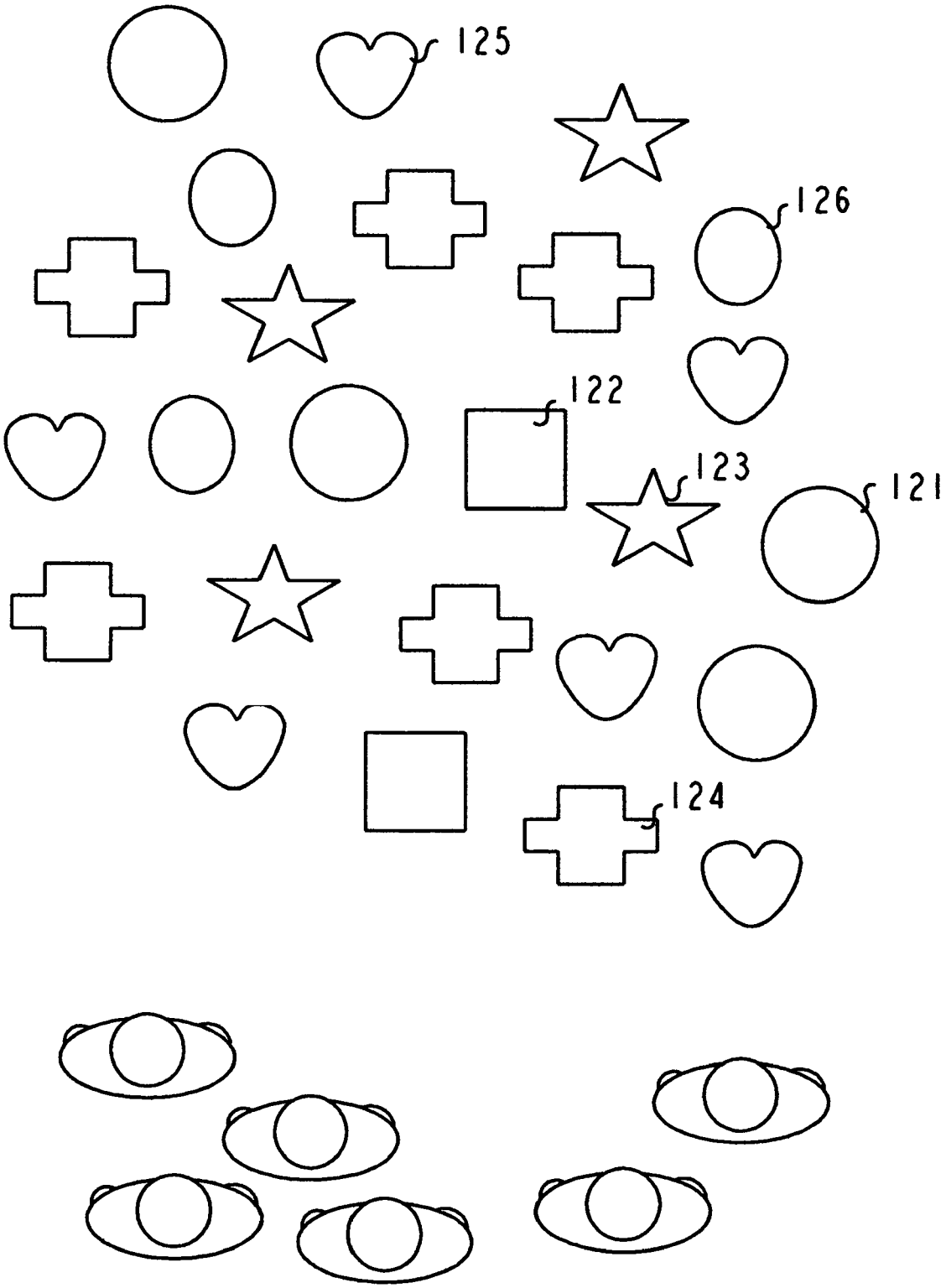
Figure 4:
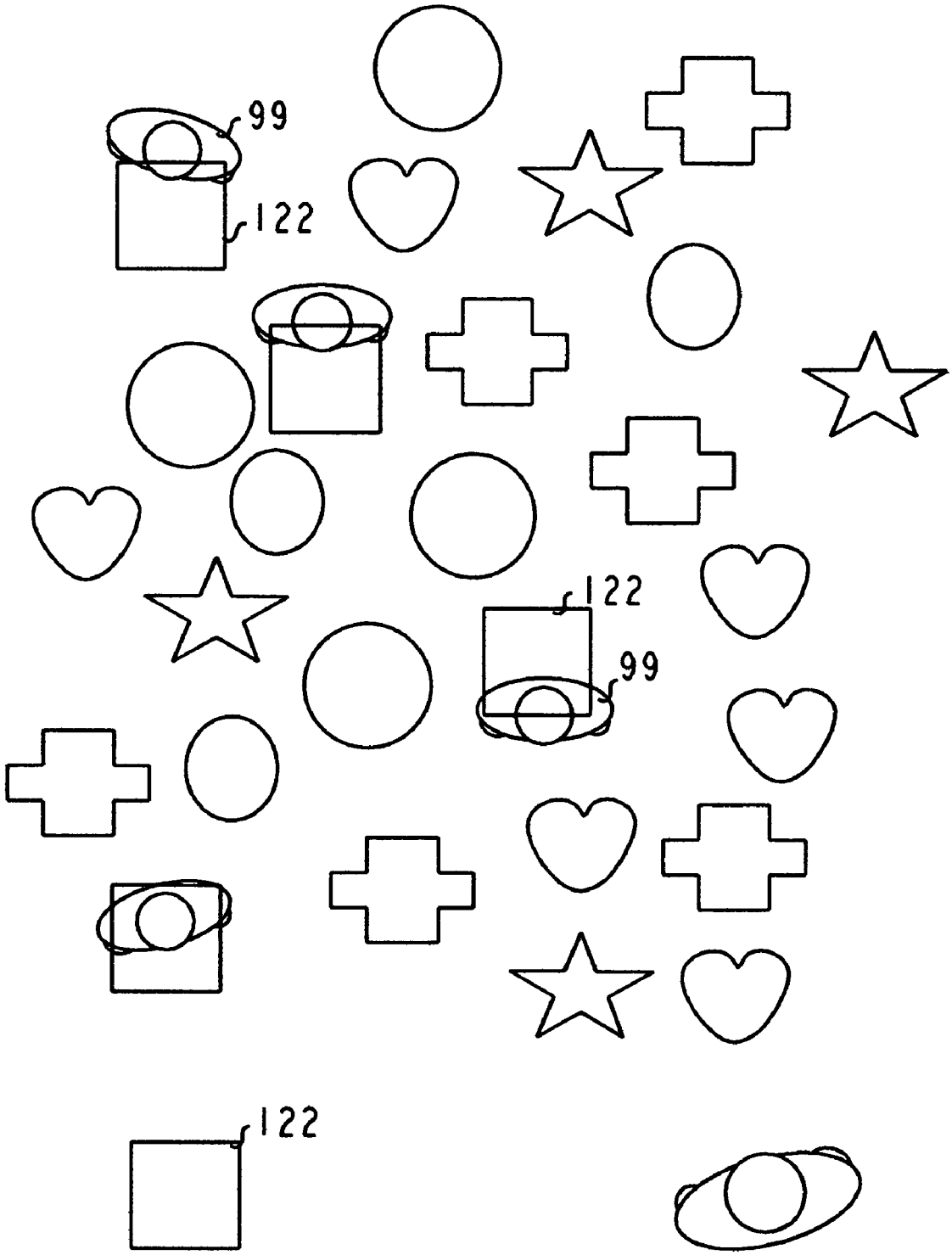
Figure 5:
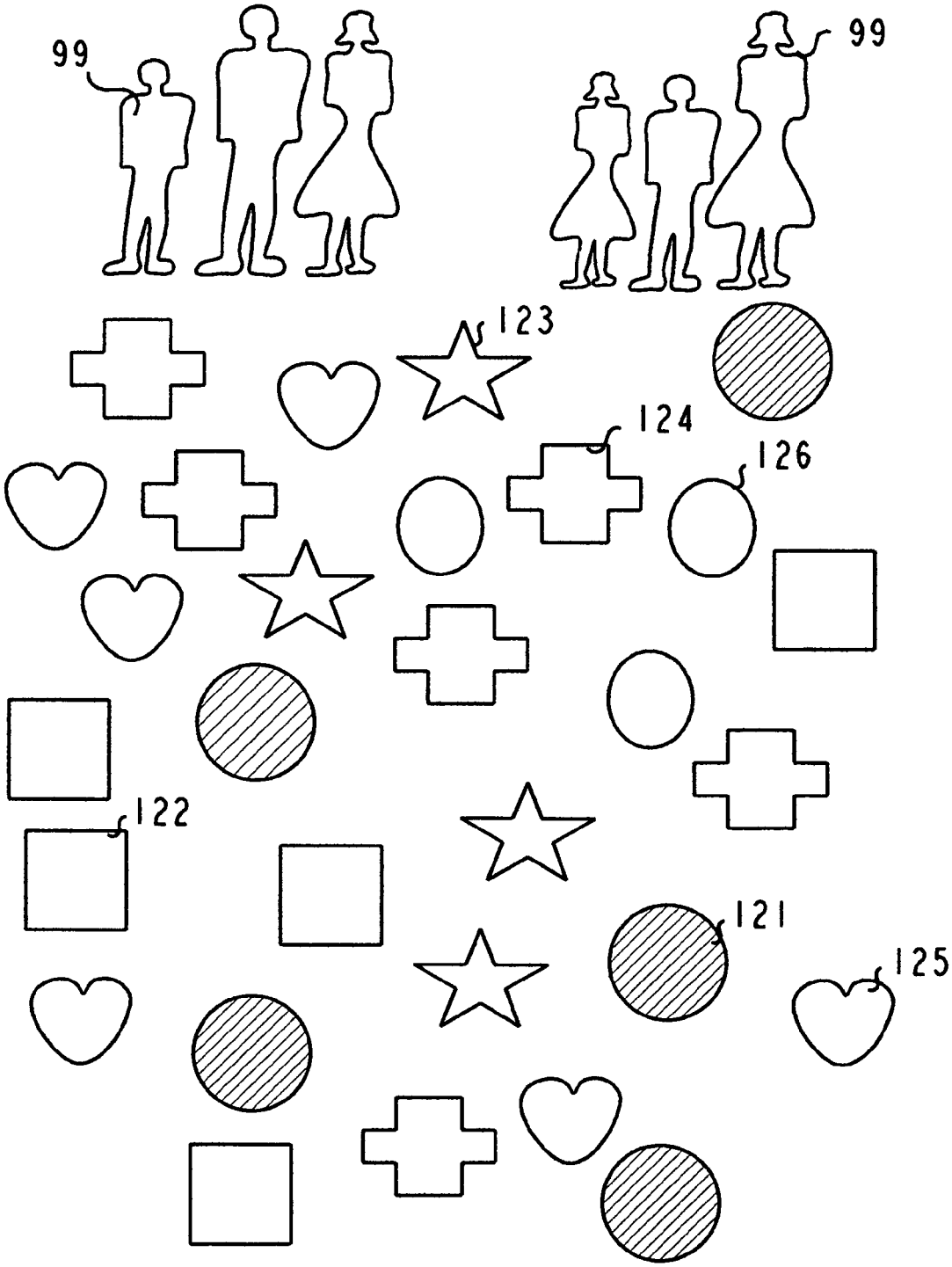
Figure 6:
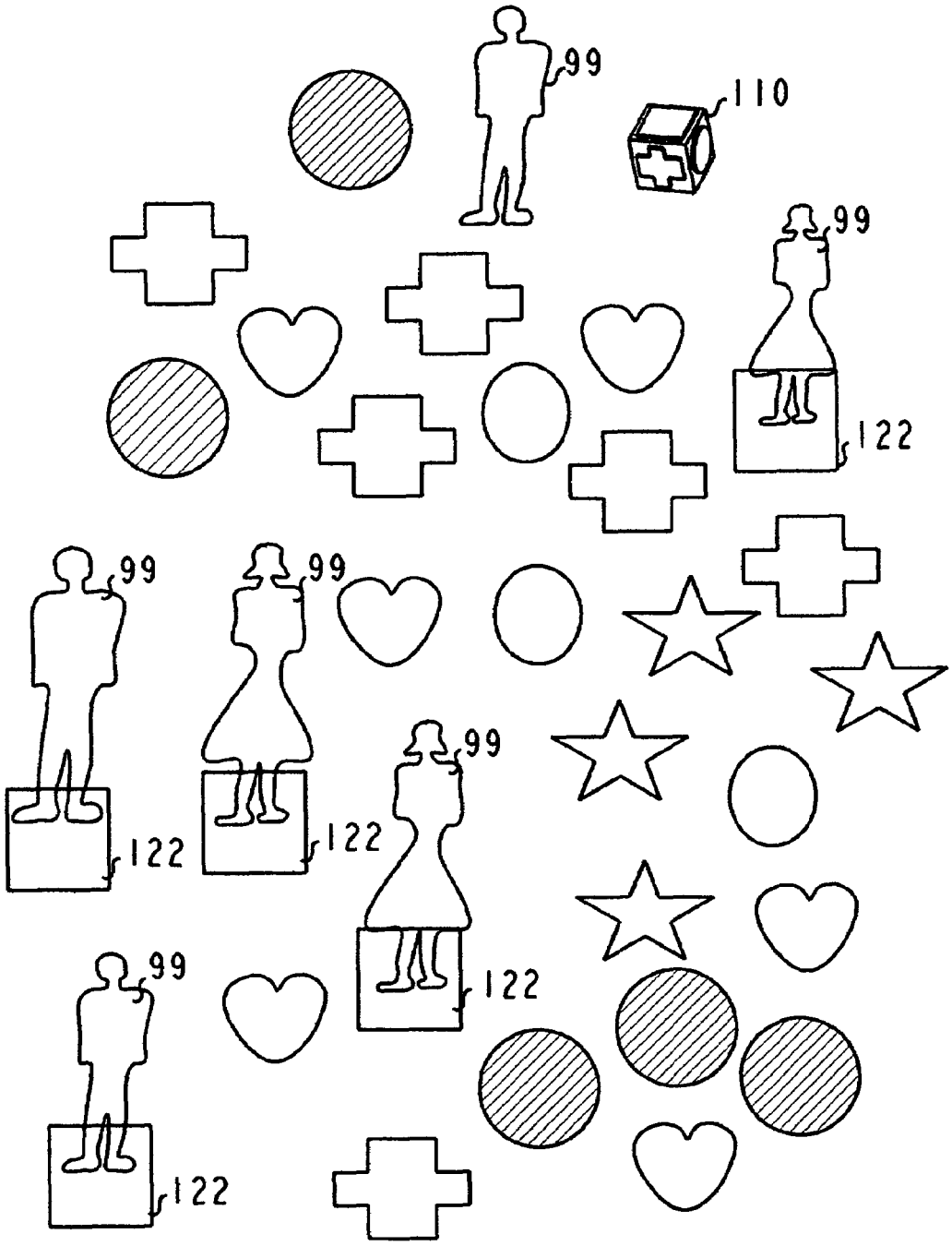

BRIEF DESCRIPTION OF THE DRAWINGS a) FIG. 1 shows two views of a 6 sided dice with six different graphics.

b) FIG. 2 shows plan view of the six graphics on the dice.

c) FIG. 3 shows plan view of the P Players and (P−1)×N bases before the start of the game.

d) FIG. 4 shows plan view of the bases after the dice is cast and one player without a base is eliminated.

e) FIG. 5 shows relationship between number of players, number of bases and the number of sides of the dice. In this illustration N is number of sides on the dice which is 6 P is the number of players which is also coincidentally 6 and the number of bases=(P−1)×N=(6−1)×5=30. Thus each of the 6 graphics is reproduced (P−1) or 5 times.

f) FIG. 6 is a 3 D non isometric perspective view of the P=6 players, N=6 sided dice and number of bases=30.

DETAILED DESCRIPTION OF THE BEST MODE PREFERRED EMBODIMENT

As shown in the drawings wherein like numerals represent like parts throughout the several views, there is generally disclosed in FIG. 1 shows two views of a 6 sided dice 110 with six different graphics 120.

FIG. 2 shows plan view of the six graphics 120 on the dice 110. FIG. 3 shows plan view of the P Players 99 and (P−1)×N bases 130 before the start of the game. FIG. 4 shows plan view of the bases 130 after the dice 110 is cast and one player without a base 130 with matching graphic on the dice is eliminated. FIG. 5 shows relationship between number of players 99, number of bases 130 and the number of sides of the dice.

In this illustration N is number of sides on the dice which is 6 P is the number of players which is also coincidentally 6 and the number of bases=(P−1)×N=(6−1)×5=30.

Thus each of the 6 graphics is reproduced (P−1) or 5 times. FIG. 6 is a 3 D non-isometric perspective view of the P=6 players, N=6 sided dice and number of bases=30.

The illustration embodiment used six graphics viz Graphic 1—Circle 121; Graphic 2—Square 122; Graphic 3—Star 123; Graphic 4—Cross or Plus 124; Graphic 5—Heart 125 and Graphic 6—Oval or Ellipse 126. The Cube or the dice can be manufactured in several ways as such blow molding, rotational molding, or injection molding using rubber material or materials that when formed are not dangerous or cause injury to the user.

The base can be made also in several ways such as Die cutting or injection molding. A non-slip material such as the Ultra Grip Liner™ or the like material can be used. It is a non-adhesive quilted cushion that provides the ultimate slip resistance, fully washable and durable. http://www.contactbrand.com Another material is the Easy liner by Manco. http://www.duckproducts.com.

Assembly Use and Operation

The game is played by participants from age 3 to adult. It can be played indoors as well as outdoors. The game is also known by its potential trademark name of "CHAOS". The objective of the game is to have one player left in order to be the winner. The game consists of a cube and bases. The cube has a different shape, but not limited to, indicated on top of each of its six surface. The Bases can be scattered in a pattern or randomly in an open area or space. In the illustrative embodiment of this example the game requires 6 players. Once the 6 players are chosen, the 30 bases are scattered randomly in an open area. The players are gathered around but not necessarily in an orderly pattern. An arbitrator is designated which can be an adult or a parent. One of the players can also act as a referee or arbitrator.

The arbitrator has the discretion to choose whoever would toss the cube or other dice. Once these are established, the cube is tossed into the air, rolled or bounced on the ground. The players must wait for the cube to come to rest, which will indicate on top what shape to run to and look for.

Once the chaotic search is finished, the player who doesn't have the indicated base to stand on is out of the game. One of each shape must be taken out. This will leave 5 players and 24 bases. The game is continued using the same or similar process until there's one player is left standing on the indicated shape.

The manufacturing, assembly and use of this invention is very simple even intuitive. Nonetheless the inventor suggests the following procedure for the consumer market. 1. Select number of players P and a dice with number of sides N 2. Make (P−1)×N bases.

3. Reproduce each graphic on the dice once as well as P−1 times on the bases.

The inventor has given a non-limiting description of the system of this invention. Due to the simplicity and elegance of the design of this invention designing around it is very difficult if not impossible. Nonetheless many changes may be made to this design without deviating from the spirit of this invention. Examples of such contemplated variations include the following:

1. The shape and size and quantity of the various members and components may be modified.

2. The color, aesthetics and materials may be enhanced or varied.

3. Different educational graphic may be selected for learning and teaching different substantive subjects through this medium of instruction.
4. Additional complimentary and complementary functions and features may be added.
5. A more economical version of the game be adapted.
6. An audio-visual computer version of the game may be employed.
7. A board version of the game may be adapted.

Thus the game is not limited to a cube and 6 bases. The shapes can be substituted for colors, numbers, letters, animal figures, images, patterns and more. It can have a version where it is played in the swimming pool and at night where glow in the dark material or other illuminating devices are used. This game can also have a software program version where the user can have the ability to customize the images to be used on the game.

Other changes such as aesthetics and substitution of newer materials as they become available, which substantially perform the same function in substantially the same manner with substantially the same result without deviating from the spirit of the invention may be made.

Following is a listing of the components used in the best mode preferred embodiment and the alternate embodiments for use with OEM as well as retrofit markets. For the ready reference of the reader the reference numerals have been arranged in ascending numerical order.

| | |
|---|---|
| 99 = | Players |
| 100 = | Chaos game generally |
| 110 = | Dice |
| 120 = | Graphic on dice or base |
| 121 = | Graphic 1 - Circle |
| 122 = | Graphic 2 - Square |
| 123 = | Graphic 3 - Star |
| 124 = | Graphic 4 - Cross or Plus |
| 125 = | Graphic 5 - Heart |
| 126 = | Graphic 6 - Oval or Ellipse |
| 130 = | Base generally |

What is claimed is:

1. A holistic game system comprising:

a) a dice having N number of sides, each of said sides having a different graphic; and b) a plurality of portable bases equal to (P−1)×N in number, where P is the number of players and each graphic has (P−1) number of bases.

2. The holistic game system of claim 1 wherein the dice is thrown to select one of said N number of graphics, reproduced on said N/(P−1), and wherein the each of the P number of players stand on bases having said selected graphic, resulting in one player failing to find a base with said selected graphic to stand on, and therefore resulting in said player's elimination.

3. The holistic game system of claim 1 wherein said graphics are educational.

4. The holistic game system of claim 1 wherein said graphics comprises geometric shapes.

5. The holistic game system of claim 1 wherein said graphics are humorous.

6. The holistic game system of claim 1 wherein said graphics are personalized.

7. The holistic game system of claim 1 wherein N is in the range between 6 and 12.

8. The holistic game system of claim 1 wherein N is 6.

9. The holistic game system of claim 1 wherein N is 8.

10. The holistic game system of claim 1 wherein N is 12.

11. The holistic game system of claim 1 wherein N is 14.

12. The method of playing a holistic game of claim 1 where N is 6.

13. The method of playing a holistic game of claim 1 where N is 8.

14. The method of playing a holistic game of claim 1 where N is 12.

15. A method of playing a holistic game comprising the steps of:

a) selecting a dice having N number of sides with each side having a different graphic;

b) making (P−1)×N and reproducing said graphic of said randomizer on said N/(P−1) bases;

c) scattering in pattern or randomly arranging said bases on the floor;

d) explaining the objectives and the rules of the game to the P number of players;

e) casting said dice to select a graphic;

f) eliminating one player having failed to select a base having the graphic;

g) eliminating one base of each graphic; and h) recasting said dice and eliminating another said base of each graphic and repeating until a sole winner is identified with the same base graphic as the latest cast of said dice graphic.

16. The method of playing a holistic game of claim 15 wherein said graphics are educational.

17. The method of playing a holistic game of claim 15 wherein said graphics comprise geometric shapes.

18. The method of playing a holistic game of claim 15 wherein said graphics are humorous.

19. The method of playing a holistic game of claim 15 wherein said graphics are personalized.

20. The method of playing a holistic game of claim 15 where N is in the range between 6 and 12.

* * * * *